US010105716B2

(12) United States Patent
Vielhuber

(10) Patent No.: US 10,105,716 B2
(45) Date of Patent: Oct. 23, 2018

(54) SOLID BOWL CENTRIFUGE HAVING A DAM EDGE WITH AN ENERGY RECOVERY DEVICE LOCATED ON THE DAM EDGE AND AT LEAST SECTIONS OF THE DAM EDGE ARE PIVOTED TOWARD A ROTATIONAL DIRECTION OF THE SOLID BOWL CENTRIFUGE AS VIEWED FROM A ROTATIONAL AXIS

(71) Applicant: Flottweg SE, Vilsbiburg (DE)

(72) Inventor: Benno Vielhuber, Vilsbiburg (DE)

(73) Assignee: FLOTTWEG SE, Vilsbiburg (DE)

( * ) Notice: Subject to any disclaimer, the term of this patent is extended or adjusted under 35 U.S.C. 154(b) by 512 days.

(21) Appl. No.: 14/764,188

(22) PCT Filed: Nov. 8, 2013

(86) PCT No.: PCT/DE2013/100379
§ 371 (c)(1),
(2) Date: Jul. 29, 2015

(87) PCT Pub. No.: WO2014/117760
PCT Pub. Date: Aug. 7, 2014

(65) Prior Publication Data

US 2015/0360240 A1 Dec. 17, 2015

(30) Foreign Application Priority Data

Jan. 29, 2013 (DE) ..... 10 2013 001 436

(51) Int. Cl.
*B04B 1/20* (2006.01)
*B04B 11/02* (2006.01)
(Continued)

(52) U.S. Cl.
CPC ..... *B04B 9/06* (2013.01); *B04B 1/20* (2013.01); *B04B 11/02* (2013.01); *B04B 11/06* (2013.01);
(Continued)

(58) Field of Classification Search
CPC B04B 1/20; B04B 11/00; B04B 11/02; B04B 2001/2083; B04B 2001/2075; B04B 7/08
(Continued)

(56) References Cited

U.S. PATENT DOCUMENTS 4,575,370 A * 3/1986 LaMontagne ..... B04B 1/20 494/53
5,217,428 A * 6/1993 Schlip ..... B04B 1/20 494/53
(Continued)

FOREIGN PATENT DOCUMENTS

DE 10 2010 032 503 2/2012
EP 0 186 761 7/1986
(Continued)

OTHER PUBLICATIONS

International Search Report dated Feb. 17, 2014.
German Office Action dated Nov. 7, 2013.

*Primary Examiner* — Charles Cooley
(74) *Attorney, Agent, or Firm* — Gerald E. Hespos; Michael J. Porco; Matthew T. Hespos

(57) ABSTRACT

A solid bowl centrifuge has a centrifuge bowl that can be rotated in a rotational direction about a longitudinal axis during operation. An end face of the centrifuge bowl has at least one flow-off opening for the flow-off of clarified material from the centrifuge bowl. A dam edge bounds the flow-off opening in the radially outward direction, and an energy recovery device is located on the dam edge for recovering energy of the clarified material flowing. The dam
(Continued)

edge is pivoted toward the rotational direction at least in some sections, as viewed from the longitudinal axis.

10 Claims, 3 Drawing Sheets

(51) Int. Cl.
*B04B 9/06* (2006.01)
*B04B 11/06* (2006.01)

(52) U.S. Cl.
CPC ..... *B04B 2001/2075* (2013.01); *B04B 2001/2083* (2013.01)

(58) Field of Classification Search
USPC ..... 494/53, 54, 56, 57; 210/380.1, 380.3
See application file for complete search history.

(56) References Cited

U.S. PATENT DOCUMENTS 7,022,061 B2 * 4/2006 Leung ..... B04B 1/20 494/56
8,968,169 B2 * 3/2015 Eiken ..... B04B 1/20 494/53
9,028,387 B2 * 5/2015 Eiken ..... B04B 1/20 494/2
9,908,125 B2 * 3/2018 Geehan ..... B04B 11/06
9,993,831 B2 * 6/2018 Pasol ..... B04B 11/02
2004/0072667 A1 * 4/2004 Leung ..... B04B 1/20 494/56
2004/0072668 A1 * 4/2004 Leung ..... B04B 1/20 494/56
2012/0021889 A1 * 1/2012 Eiken ..... B04B 1/20 494/52
2012/0028782 A1 * 2/2012 Eiken ..... B04B 1/20 494/2
2014/0235423 A1 * 8/2014 Pasol ..... B04B 1/20 494/56
2015/0165449 A1 * 6/2015 Horstkoetter ..... B04B 1/20 494/53
2015/0165450 A1 * 6/2015 Schlarb ..... B04B 1/20 494/53
2015/0217303 A1 * 8/2015 Bauer ..... B04B 1/2016 494/4
2015/0273482 A1 * 10/2015 Bauer ..... B04B 1/20 494/43
2015/0360240 A1 * 12/2015 Vielhuber ..... B04B 1/20 494/24
2016/0067718 A1 * 3/2016 Schlarb ..... B04B 1/20 494/50

FOREIGN PATENT DOCUMENTS

JP 11-179236 * 7/1999
WO 2010/076752 7/2010
WO 2012/013624 2/2012
WO 2012/062337 5/2012

* cited by examiner

SOLID BOWL CENTRIFUGE HAVING A DAM EDGE WITH AN ENERGY RECOVERY DEVICE LOCATED ON THE DAM EDGE AND AT LEAST SECTIONS OF THE DAM EDGE ARE PIVOTED TOWARD A ROTATIONAL DIRECTION OF THE SOLID BOWL CENTRIFUGE AS VIEWED FROM A ROTATIONAL AXIS

BACKGROUND

1. Field of the Invention

The invention relates to a solid bowl centrifuge having a centrifuge bowl that can be rotated in a rotational direction about a longitudinal axis during operation, at an end face of which centrifuge bowl at least one flow-off opening for the flow-off of clarified material from the centrifuge bowl, a dam edge, which bounds the flow-off opening in the radially outward direction, and an energy recovery device located on the dam edge for recovering energy of the clarified material flowing off are formed. The invention further relates to an assembly, which is formed by such a dam edge and by such an energy recovery device and is intended to be attached to an end face of a centrifuge bowl.

2. Description of the Related Art

For solid bowl centrifuges of the type in question, providing several flow-off openings on an end face of the centrifuge bowl of the solid bowl centrifuge, through which flow-off openings the clarified material can flow off over an associated dam edge, is generally known. The dam edge forms the radially inner edge of an associated dam plate, which is attached to the end face of the centrifuge bowl in a radially adjustable manner.

In order that the kinetic energy of the outflowing material can be reused to drive the rotational motion of the centrifuge bowl, energy recovery devices are meanwhile provided on such dam edges. Thus, among other things, providing deflecting devices on the end face of a centrifuge bowl, by means of which deflecting devices the material flow of the clarified material is deflected in the tangential direction, is known. The material, which then exits not axially but rather tangentially against the rotational direction of the centrifuge bowl, transfers a momentum in the rotational direction to the centrifuge bowl, which momentum accordingly drives the centrifuge bowl in the rotational direction. Such deflecting devices are known, e.g., from WO 2012 013624 A2. From WO 2010 076752 A1 as well, an energy recovery device with a weir edge is known in which the weir edge extends on a radial plane perpendicular to the rotational or longitudinal axis of the centrifuge drum. On this plane perpendicular to the longitudinal axis, the weir edge has an inclination toward the radial direction of at least 60°, preferably about 82°.

The problem addressed by the invention is that of creating a solid bowl centrifuge whose energy recovery device is especially effective.

SUMMARY

According to the invention, this problem is solved by means of a solid bowl centrifuge having a centrifuge bowl that can be rotated in a rotational direction about a longitudinal axis during operation, at an end face of which centrifuge bowl at least one flow-off opening for the flow of clarified material from the centrifuge bowl, a dam edge, which bounds the flow-off opening in the radially outward direction, and an energy recovery device located on the dam edge for recovering energy of the clarified material flowing off are formed. According to the invention, the dam edge is arranged pivoted toward the rotational direction at least in some sections, as viewed from the longitudinal axis such that the flow of the discharged product behind the dam or weir edge is also moved initially in the direction of rotation and is aligned even more strongly toward the subsequent energy recovery device.

In the case of the solid bowl centrifuge according to the invention, the particular dam edge extends not transversely to the longitudinal axis of the centrifuge but rather aslant to the longitudinal axis of the centrifuge. Highly surprisingly, the dam edge is not pivoted in such a way that the dam edge already deflects the material flowing off tangentially against the rotational direction. One could think that such a deflection (similar to the deflection in the case of a jet propulsion device) would be especially sensible with regard to energy.

Instead, the dam edge according to the invention is pivoted toward the rotational direction in such a way that, consequently, the flow of the material flowing off after the dam edge also is initially still moved in the rotational direction. In this way, according to the invention, the material flowing off after the dam edge is directed toward a following energy recovery device even more strongly than in traditional solid bowl centrifuges having a flow-off of clarified material that is purely axial at the dam edge.

The solution according to the invention is based on the insight that the energy recovery effect of energy recovery devices of the stated type results, in particular, from the material flowing axially against the associated deflecting surface at the energy recovery devices and then leaving said deflecting surface in the tangential direction. This impact and deflection produce an especially strong momentum transfer from the material flowing off to the centrifuge bowl. If, instead, the material flowing off is deflected tangentially against the rotational direction relatively softly as a homogeneous flow, a large part of the momentum of the material flowing off is lost as internal liquid friction.

The solution according to the invention is accordingly superior to traditional solutions in regard to the amount of energy recovered.

This effect of the solution according to the invention is especially pronounced in that the dam edge is arranged pivoted toward the rotational direction at an angle between 2° and 45°, preferably between 5° and 30°, especially preferably between 10° and 15°, at least in some sections. Furthermore, the dam edge according to the invention is especially preferably arranged pivoted toward the rotational direction overall.

An overflow surface directed radially outward for the material flowing off is preferably formed after the dam edge in the flow direction of the material flowing off over the dam edge. By means of this overflow surface, the material flowing off is advantageously conducted at least slightly radially outward, whereby the flow-off velocity of the material flowing off can be increased somewhat. Thus, the impact velocity of the material against the energy recovery device is increased so that especially efficient momentum transfer can be achieved there. This overflow surface extends preferably along the entire dam edge and is especially advantageously formed directly adjacent to the dam edge.

The overflow surface is preferably arranged pivoted radially outward in relation to the longitudinal axis at an angle between 10° and 65°, preferably between 20° and 55°, especially preferably between 30° and 45°. By means of the overflow surface tilted outward in such a way, especially advantageous flow-off velocities can be achieved for the material flowing off.

The energy recovery device according to the invention is preferably designed with a deflecting surface that deflects the material flowing off against the rotational direction, in accordance with the explanation above. As viewed in the direction of the longitudinal axis, the deflecting surface is advantageously arranged axially immediately after the dam edge.

As viewed in the direction of the longitudinal axis, the deflecting surface is preferably arranged exclusively radially outside of the dam edge. This deflecting surface is especially small in the radial direction and thus has low air flow resistance. Furthermore, the deflecting surface offers only a small surface of attack for material flowing off, which is swirled at a preceding flow-off opening. Material hitting the following deflecting surface in such a way would contribute to a braking of the centrifuge bowl.

In order to achieve a simple adjustment of a pond depth on the solid bowl centrifuge according to the invention while also still achieving effective energy recovery, the dam edge according to the invention and its energy recovery device are preferably designed as an assembly that can be jointly adjusted on the centrifuge bowl. Accordingly, the invention also relates to an assembly that is formed by such a dam edge according to the invention and the associated energy recovery device and is intended to be attached to an end face of a centrifuge bowl.

Below, an embodiment of the solution according to the invention is explained in more detail on the basis of the enclosed schematic drawings.

DETAILED DESCRIPTION

Figure 1:
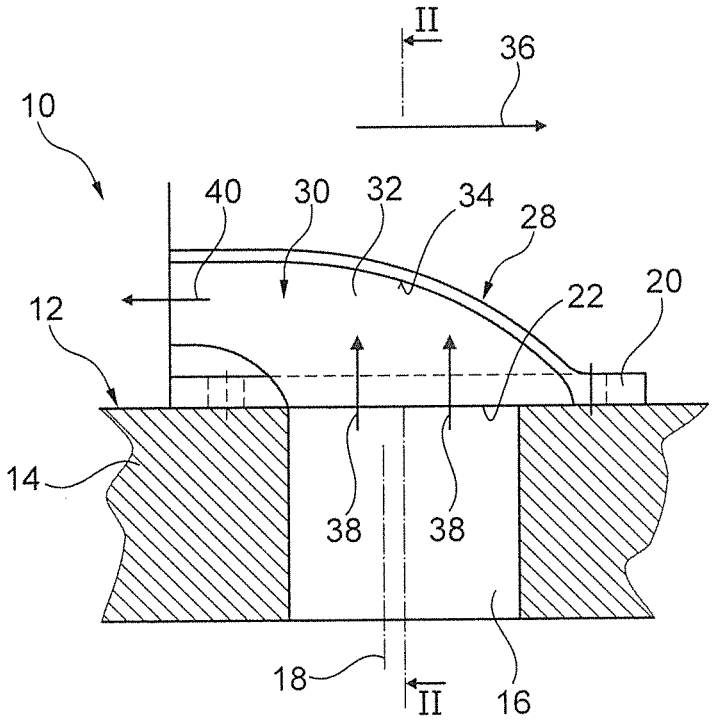
Fig. 1 Prior Art
FIG. 1 shows a partially cut side view of a centrifuge bowl, comprising a dam plate and an energy recovery device of a solid bowl centrifuge according to the prior art.
Figure 2:
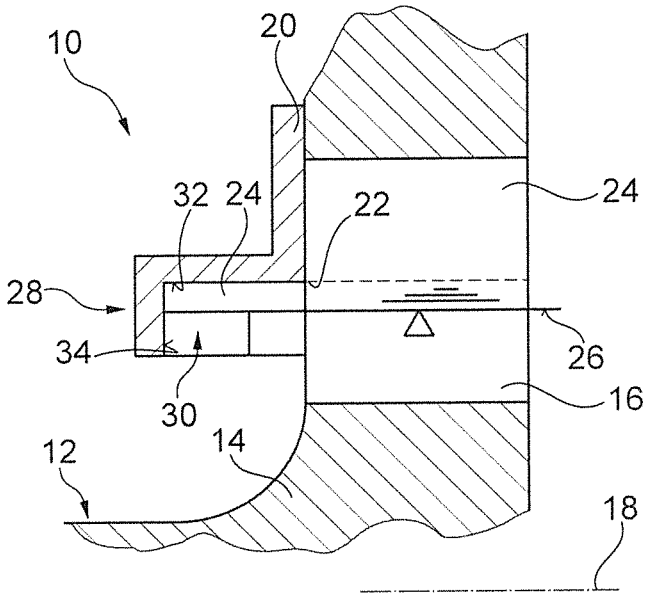
Fig. 2 Prior Art
FIG. 2 shows section II-II in FIG. 1.

In FIGS. 1 and 2, the end wall 14 of a centrifuge bowl 12 of a solid bowl centrifuge 10 is shown. One of several flow-off openings 16 extending axially through the end wall 14, in the direction of a longitudinal axis 18 of the centrifuge bowl 12, is illustrated on the end wall 14. A dam plate 20 is attached to the outside of the end wall 14, in front of the flow-off opening 16, in such a way that the dam plate is stationary but adjustable. The dam plate 20 protrudes in front of the flow-off opening 16, and therefore the dam plate 20 covers the flow-off opening 16 on the outside in the radial outer region of the flow-off opening 16. The dam plate 20 has a dam edge 22 at the edge of the dam plate 20 directed radially inward. This dam edge 22 according to the prior art extends along the end wall 14 and thus transversely to the longitudinal axis 18, or at an angle of 90° to the longitudinal axis 18. The dam edge 22 holds back clarified material 24 in the centrifuge bowl 12, and therefore, during operation of the solid bowl centrifuge 10, this clarified material 24 accumulates there with a pond depth 26 and subsequently flows off over the dam edge 22 largely continuously.

After or downstream of the dam edge 22 in the flow direction of the clarified material 24, there is an energy recovery device 28 according to the prior art on the outside of the dam plate 20. This energy recovery device 28 is designed as a flow-off channel 30, which has a flat bottom surface 32 extending tangentially at the height of the dam edge 22. A deflecting surface 34 extends to the bottom surface 32 perpendicularly as part of the flow-off channel 30. According to the prior art, the deflecting surface 34 extends in an arcuate shape in front of the region of the flow-off opening 16 that is open as viewed in the longitudinal direction. The deflecting surface 34 deflects the clarified material 24, which approaches axially through the flow-off opening 16 at the radial inside and under the dam edge 22 in an inflow direction 38, in a tangential direction into an outflow direction 40. The centrifuge bowl 12 rotates in a rotational direction 36, and the clarified material 24 is deflected by the deflecting surface 34 in such a way that the clarified material 24 exits the energy recovery device 28 tangentially against this rotational direction 36. When the clarified material 24 exits, the clarified material 24 "pushes off" from the centrifuge bowl 12, whereby the clarified material 24 transfers part of its momentum to the centrifuge bowl 12 and contributes to energy recovery at the centrifuge bowl 12. This "pushing off" is lessened by the internal liquid friction in the clarified material 24 and in that the centrifuge bowl 12 turns further in the rotational direction 36 at the same time. Thus, the centrifuge bowl 12 partially evades the pushing off.

Figure 3:
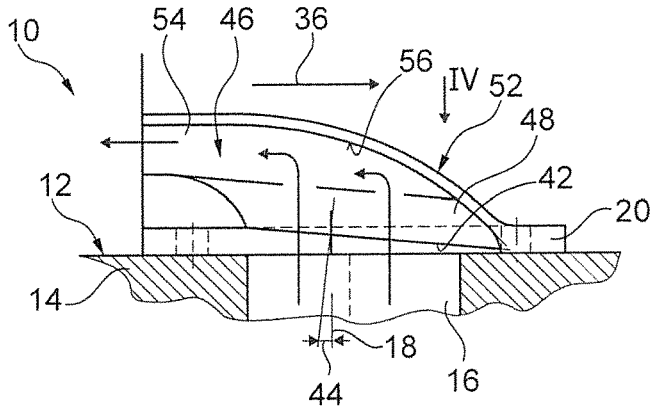
FIG. 3 shows a partially cut side view of a centrifuge bowl, comprising a dam plate and an energy recovery device, of a first embodiment of a solid bowl centrifuge according to the invention.
Figure 4:
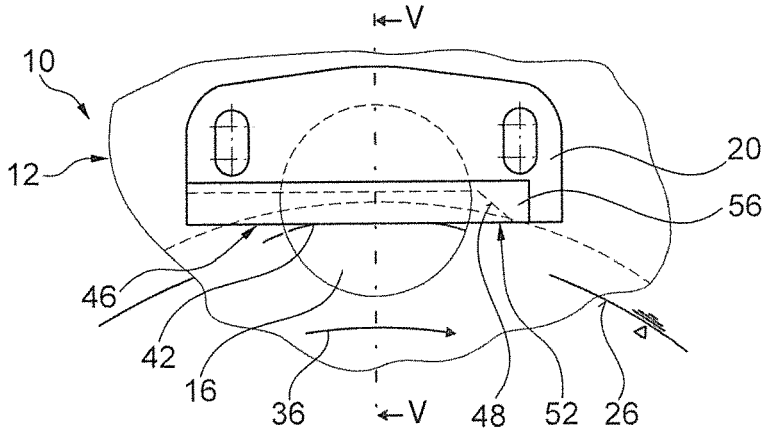
FIG. 4 shows view IV according to FIG. 3.
Figure 5:
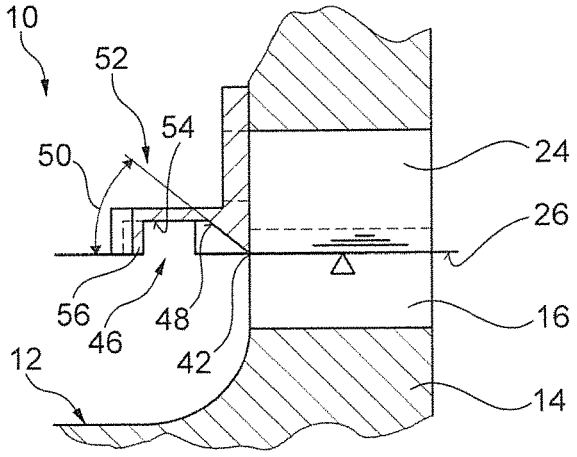
FIG. 5 shows section V-V according to FIG. 4.

In FIGS. 3 to 5, an embodiment of a solid bowl centrifuge 10 is illustrated by means of its centrifuge bowl 12, on the dam plate 20 of which a dam edge 42 according to the invention is provided. This dam edge 42 is pivoted by an angle 44 of 10° toward the rotational direction 36 with respect to the longitudinal axis 18 in the total extension or length of the dam edge as a straight section. Thus, the dam edge 42 does not extend in the transverse direction but rather points toward the rotational direction 36 at an angle on the outside.

A flow-off channel 46 according to the invention is located after the dam edge 42 in the flow direction of the clarified material 24. The flow-off channel 46 is designed initially with a flat overflow surface 48 tilted radially outward. The overflow surface 48 is tilted at an angle 50 of 45° from the longitudinal axis 18 of the centrifuge bowl 12 and extends over the entire width of the dam edge 42. The overflow surface 48 is part of an energy recovery device 52 according to the invention and directs the material 24 flowing off over the angled dam edge 42 slightly radially outward and against the rotational direction 36. In the process, this material 24 is accelerated with regard to its flow velocity. Thus, the potential energy of the material 24 is converted into kinetic energy to a certain extent within the energy recovery device 52.

Directly after the overflow surface 48, the flow-off channel 46 of the energy recovery device 52 according to the invention also comprises a flat bottom surface 54, which, however, lies somewhat further radially outside than the dam edge 42. Furthermore, an arcuate deflecting surface 56 is also provided. The material 24 flowing off is conducted toward this deflecting surface 56 slightly against the rotational direction 36 by the overflow surface 48, as explained above, especially in an accelerated manner. Thus, a higher energy input or a strong momentum transfer from the clarified material 24 flowing off to the energy recovery device 52 can occur at the deflecting surface 56. Thus, the deflecting surface 56 can be designed especially small, and it is sufficient if the deflecting surface 56 extends radially inward only to the depth of the dam edge 42. With the deflecting surface 56 that is small in such a way, a relatively small flow resistance on the outside of the centrifuge bowl 12, which rotates at high speed, is achieved for the energy recovery device 52.

Figure 6:
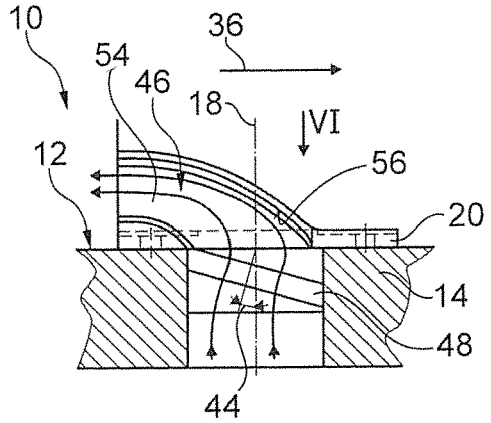
FIG. 6 shows a partially cut side view of a centrifuge bowl, comprising a dam plate and an energy recovery device, of a second embodiment of a solid bowl centrifuge according to the invention.
Figure 7:
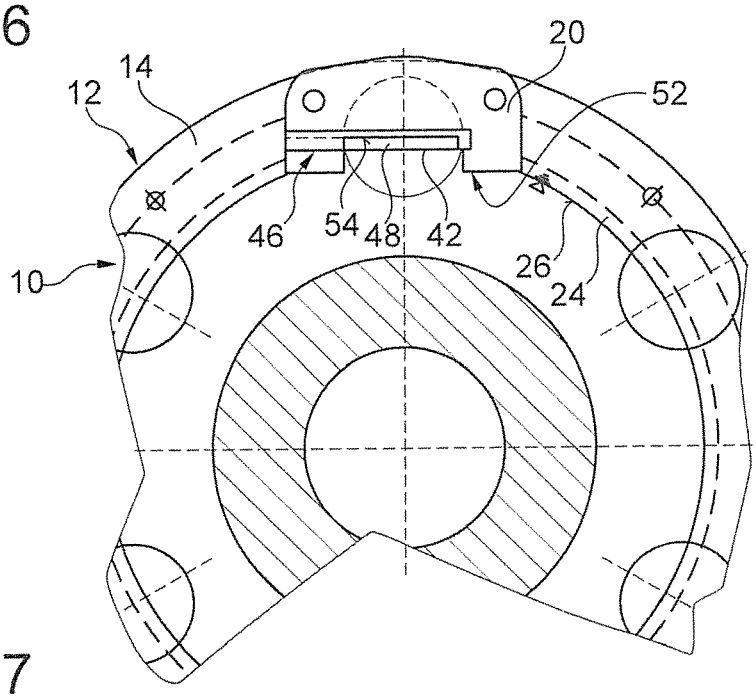
FIG. 7 shows view VII according to FIG. 6.

FIGS. 6 and 7 show an embodiment of a dam edge 42 that is preferred according to the invention, together with an energy recovery device 52 according to the invention, wherein the dam edge 42 is oriented at angle 44 of 20° to the longitudinal axis 18.

Figure 8:
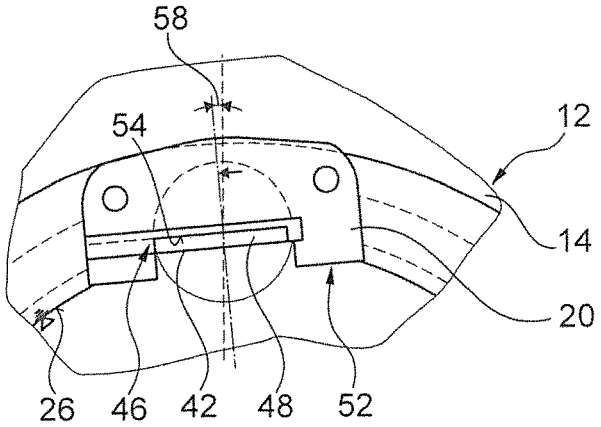
FIG. 8 shows part of a view according to FIG. 7 of a third embodiment of a solid bowl centrifuge according to the invention.

Finally, in FIG. 8, a very similar embodiment is shown, wherein the associated dam plate 20 together with the dam edge 42 according to the invention and the energy recovery device 52 is tilted radially inward at an angle 58 between 5° and 10°, preferably of 8°, as viewed from the tangential direction against the rotational direction 36.

Finally, it is noted that all features stated in the application documents and in particular in the dependent claims, despite the formal reference made to one or more certain claims, should also be given independent protection individually or in any combination.

LIST OF REFERENCE SIGNS

10 solid bowl centrifuge
12 centrifuge bowl
14 end wall
16 flow-off opening
18 longitudinal axis of the centrifuge bowl
20 dam plate
22 dam edge according to the prior art
24 clarified material
26 pond depth
28 energy recovery device according to the prior art
30 flow-off channel according to the prior art
32 bottom surface according to the prior art
34 deflecting surface according to the prior art
36 rotational direction
38 inflow direction of the clarified material (axial)
40 outflow direction of the clarified material (tangential)
42 dam edge according to the invention
44 angle of the tilt of the dam edge in relation to the longitudinal axis
46 flow-off channel according to the invention
48 overflow surface according to the invention
50 angle of the tilt of the overflow surface in relation to the longitudinal axis
52 energy recovery device according to the invention
54 bottom surface according to the invention
56 deflecting surface according to the invention
58 angle of the inclination of the bottom surface in relation to the radial direction

The invention claimed is:

1. A solid bowl centrifuge (10) comprising a centrifuge bowl (12) that can be rotated in a rotational direction (36) about a longitudinal axis (18) during operation, at least one flow-off opening (16) at an end face of the centrifuge bowl (12) for flow-off of clarified material (24) from the centrifuge bowl (12), a dam edge (22, 42), which bounds the flow-off opening (16) in a radially outward direction, and an energy recovery device (28, 52) located on the dam edge (22, 42) for recovering energy of the clarified material (24) flowing off, wherein the dam edge (42) is arranged pivoted toward the rotational direction (36) at least in some sections as viewed from the longitudinal axis (18), such that the dam edge (42) extends at a slant to the longitudinal axis (18), wherein the pivot position of the dam edge (42) toward the rotational direction (36) causes the flow of the clarified material (24) behind the dam edge (22, 42) also to moved initially in the rotational direction (36) and to direct the clarified material (24) strongly toward the energy recovery device (28, 52).

2. The solid bowl centrifuge of claim 1, wherein the at least some sections of the dam edge (42) are arranged pivoted toward the rotational direction (36) at an angle between 2° and 45° at least in some sections.

3. The solid bowl centrifuge of claim 2, wherein all of the dam edge (42) is arranged pivoted toward the rotational direction (36) overall.

4. The solid bowl centrifuge of claim 1, wherein an overflow surface (48) pivoted radially outward for the material (24) flowing off is formed after the dam edge (42) in the flow direction of the material (24) flowing off over the dam edge (42).

5. The solid bowl centrifuge of claim 4, wherein the overflow surface (48) extends along the entire dam edge (42).

6. The solid bowl centrifuge of claim 4, wherein the overflow surface (48) is arranged pivoted radially outward in relation to the longitudinal axis (18) at an angle between 10° and 65°.

7. The solid bowl centrifuge of claim 1, wherein the energy recovery device (52) has a deflecting surface (56) that deflects the material (24) flowing off against the rotational direction (36).

8. The solid bowl centrifuge of claim 7, wherein the deflecting surface (56) is arranged axially after the dam edge (42), as viewed in the direction of the longitudinal axis (18).

9. The solid bowl centrifuge of to claim 7, wherein the deflecting surface (56) is arranged exclusively radially outside of the dam edge (42), as viewed in the direction of the longitudinal axis (18).

10. The solid bowl centrifuge of claim 1, wherein the dam edge (42) and the energy recovery device (52) are designed as an assembly that can be jointly adjusted on the centrifuge bowl (12).

* * * * *